US009365794B2

(12) United States Patent
Noles, Jr. et al.

(10) Patent No.: US 9,365,794 B2
(45) Date of Patent: Jun. 14, 2016

(54) WET FRICTION CLUTCH—LUBRICANT SYSTEMS PROVIDING HIGH DYNAMIC COEFFICIENTS OF FRICTION THROUGH THE USE OF BORATED DETERGENTS

(75) Inventors: Joe R. Noles, Jr., Linden, NJ (US); Hirokazu Saito, Tokyo (JP); Philip Skinner, Abingdon (GB); Raymond F. Watts, Linden, NJ (US); Keiji Hayashi, Toyota (JP); Atsushi Suzuki, Toyota (JP); Koji Saito, Toyota (JP)

(73) Assignee: INFINEUM INTERNATIONAL LIMITED, Oxfordshire (GB)

( * ) Notice: Subject to any disclaimer, the term of this patent is extended or adjusted under 35 U.S.C. 154(b) by 294 days.

(21) Appl. No.: 13/579,645

(22) PCT Filed: Feb. 19, 2010

(86) PCT No.: PCT/US2010/024671
§ 371 (c)(1),
(2), (4) Date: Sep. 6, 2012

(87) PCT Pub. No.: WO2011/102836
PCT Pub. Date: Aug. 25, 2011

(65) Prior Publication Data

US 2013/0008756 A1 Jan. 10, 2013

(51) Int. Cl.
*C10M 141/12* (2006.01)

(52) U.S. Cl.
CPC ..... *C10M 141/12* (2013.01); *C10M 2203/1025* (2013.01); *C10M 2207/042* (2013.01); *C10M 2207/126* (2013.01); *C10M 2207/144* (2013.01); *C10M 2207/283* (2013.01); *C10M 2215/04* (2013.01); *C10M 2215/042* (2013.01); *C10M 2215/08* (2013.01); *C10M 2215/224* (2013.01); *C10M 2215/28* (2013.01);
(Continued)

(58) Field of Classification Search
CPC ..... C10M 2219/046; C10N 2240/08; C10N 2230/06
USPC ..... 508/186
See application file for complete search history.

(56) References Cited

U.S. PATENT DOCUMENTS

| | | | |
|---|---|---|---|
| 1,188,704 | A | 6/1916 | Tollstam |
| 2,001,108 | A | 5/1935 | Parker |

(Continued)

FOREIGN PATENT DOCUMENTS

| | | |
|---|---|---|
| EP | 1577370 | 2/2005 |
| JP | 2532638 | 9/1996 |

(Continued)

OTHER PUBLICATIONS

Matsuoka et al., "Effect of Lubricating Oils on Flaking in Wet Clutch", JSAE Review, vol. 17, Jan. 1, 1996, pp. 127-132, XP002606459.

*Primary Examiner* — Ellen McAvoy
(74) *Attorney, Agent, or Firm* — Kenyon & Kenyon LLP

(57) ABSTRACT

A wet friction clutch—lubricant system wherein a wet friction clutch having a cellulose—based friction lining having a surface coating of silica based particles, or a device including such a clutch, is lubricated with a lubricant composition a major amount of oil of lubricating viscosity and minor effective amounts of performance enhancing additives including (a) ashless dispersant; (b) organic phosphorus compound and (c) borated detergents; and optionally, (d) an auxiliary friction modifier.

25 Claims, 1 Drawing Sheet

(52) U.S. Cl.
CPC .. *C10M 2219/022* (2013.01); *C10M 2219/046* (2013.01); *C10M 2223/04* (2013.01); *C10M 2223/043* (2013.01); *C10M 2223/045* (2013.01); *C10M 2223/049* (2013.01); *C10M 2223/08* (2013.01); *C10N 2230/06* (2013.01); *C10N 2230/42* (2013.01); *C10N 2230/52* (2013.01); *C10N 2240/042* (2013.01); *C10N 2240/045* (2013.01)

(56) References Cited

U.S. PATENT DOCUMENTS

| | | | | |
|---|---|---|---|---|
| 2,081,075 | A | 5/1937 | Vobach | |
| 2,095,538 | A | 10/1937 | Vobach | |
| 2,144,078 | A | 1/1939 | Neely | |
| 2,163,622 | A | 6/1939 | Neely et al. | |
| 2,270,183 | A | 1/1942 | Cook et al. | |
| 2,292,205 | A | 8/1942 | Denison et al. | |
| 2,335,017 | A | 11/1943 | McNab et al. | |
| 2,399,877 | A | 5/1946 | McNab et al. | |
| 2,416,281 | A | 2/1947 | Berger et al. | |
| 2,451,345 | A | 10/1948 | McNab et al. | |
| 2,451,346 | A | 10/1948 | McNab et al. | |
| 2,485,861 | A | 10/1949 | Campbell et al. | |
| 2,501,731 | A | 3/1950 | Mertes | |
| 2,501,732 | A | 3/1950 | Mertes | |
| 2,585,520 | A | 2/1952 | Van Ess et al. | |
| 2,616,904 | A | 11/1952 | Assef et al. | |
| 2,616,905 | A | 11/1952 | Assef et al. | |
| 2,616,906 | A | 11/1952 | Assef et al. | |
| 2,616,911 | A | 11/1952 | Assef et al. | |
| 2,616,924 | A | 11/1952 | Assef et al. | |
| 2,616,925 | A | 11/1952 | Assef et al. | |
| 2,617,049 | A | 11/1952 | Assef et al. | |
| 2,671,758 | A | 3/1954 | Vinograd et al. | |
| 2,695,910 | A | 11/1954 | Assef et al. | |
| 3,018,247 | A | 1/1962 | Anderson et al. | |
| 3,018,250 | A | 1/1962 | Anderson et al. | |
| 3,018,291 | A | 1/1962 | Anderson et al. | |
| 3,178,368 | A | 4/1965 | Hanneman | |
| 3,254,025 | A | 5/1966 | Le Suer | |
| 3,275,554 | A | 9/1966 | Wagenaar | |
| 3,361,673 | A | 1/1968 | Stuart et al. | |
| 3,367,867 | A | 2/1968 | Abbott et al. | |
| 3,368,972 | A | 2/1968 | Otto | |
| 3,413,347 | A | 11/1968 | Worrel | |
| 3,438,757 | A | 4/1969 | Honnen et al. | |
| 3,480,548 | A | 11/1969 | Hellmuth et al. | |
| 3,496,105 | A | 2/1970 | Le Suer | |
| 3,502,677 | A | 3/1970 | Le Suer | |
| 3,539,633 | A | 11/1970 | Piasek et al. | |
| 3,565,804 | A | 2/1971 | Honnen et al. | |
| 3,576,743 | A | 4/1971 | Widmer et al. | |
| 3,629,109 | A | 12/1971 | Gergel et al. | |
| 3,679,584 | A | 7/1972 | Hellmuth | |
| 3,697,574 | A | 10/1972 | Piasek et al. | |
| 3,725,277 | A | 4/1973 | Worrel | |
| 3,725,480 | A | 4/1973 | Traise et al. | |
| 3,726,882 | A | 4/1973 | Traise et al. | |
| 3,798,247 | A | 3/1974 | Piasek et al. | |
| 3,803,039 | A | 4/1974 | Piasek et al. | |
| 3,829,381 | A | 8/1974 | Le Suer | |
| 3,865,737 | A | 2/1975 | Kemp | |
| 3,907,691 | A | 9/1975 | King et al. | |
| 3,909,691 | A | 9/1975 | Wilson et al. | |
| 3,985,802 | A | 10/1976 | Piasek et al. | |
| 4,100,085 | A | 7/1978 | Peditto et al. | |
| 4,129,589 | A | 12/1978 | Eliades et al. | |
| 4,137,184 | A | 1/1979 | Bakker | |
| 4,142,980 | A | 3/1979 | Karll et al. | |
| 4,184,740 | A | 1/1980 | d'Auria et al. | |
| 4,212,752 | A | 7/1980 | Peditto et al. | |
| 4,231,759 | A | 11/1980 | Udelhofen et al. | |
| 4,234,435 | A | 11/1980 | Meinhardt et al. | |
| 4,617,135 | A | 10/1986 | Muir | |
| 4,622,158 | A | 11/1986 | Walsh | |
| 4,647,387 | A | 3/1987 | Muir | |
| 4,741,848 | A | 5/1988 | Koch et al. | |
| 4,752,416 | A | 6/1988 | Scharf et al. | |
| 4,792,410 | A | 12/1988 | Schwind et al. | |
| 4,857,214 | A | 8/1989 | Papay et al. | |
| 4,873,009 | A | 10/1989 | Anderson | |
| 4,880,550 | A | 11/1989 | Hunt | |
| 4,957,651 | A | 9/1990 | Schwind | |
| 4,959,168 | A | 9/1990 | Schroeck | |
| 4,965,003 | A | 10/1990 | Schlicht | |
| 4,965,004 | A | 10/1990 | Schlicht et al. | |
| 5,037,565 | A | 8/1991 | King | |
| 5,314,633 | A | 5/1994 | Ryer et al. | |
| 5,585,166 | A | 12/1996 | Kearsey | |
| 5,635,459 | A * | 6/1997 | Stoffa et al. | 508/186 |
| 5,750,476 | A | 5/1998 | Nibert et al. | |
| 5,840,662 | A | 11/1998 | Nibert et al. | |
| 5,840,663 | A | 11/1998 | Nibert et al. | |
| 5,942,472 | A | 8/1999 | Watts et al. | |
| 6,121,168 | A | 9/2000 | Irifune et al. | |
| 6,451,745 | B1 * | 9/2002 | Ward | 508/192 |
| 6,617,287 | B2 * | 9/2003 | Gahagan et al. | 508/192 |
| 6,875,711 | B2 * | 4/2005 | Chen et al. | 442/72 |
| 7,371,710 | B2 * | 5/2008 | Morita | 508/156 |
| 7,737,092 | B2 * | 6/2010 | Ward et al. | 508/162 |
| 7,820,599 | B2 * | 10/2010 | Kasai | 508/192 |
| 8,445,417 | B2 * | 5/2013 | Baker et al. | 508/186 |
| 8,546,311 | B2 * | 10/2013 | Fahl et al. | 508/171 |
| 8,703,669 | B2 * | 4/2014 | Iyer | 508/187 |
| 2002/0165102 | A1 * | 11/2002 | Hata et al. | 508/192 |
| 2004/0192562 | A1 | 9/2004 | Morita | |
| 2004/0204325 | A1 * | 10/2004 | Takahashi | 508/186 |
| 2005/0026790 | A1 * | 2/2005 | Komatsubara et al. | 508/160 |
| 2006/0264340 | A1 * | 11/2006 | Iyer et al. | 508/188 |
| 2007/0049916 | A1 | 3/2007 | Isaacson et al. | |
| 2007/0128447 | A1 * | 6/2007 | Hazel et al. | 428/426 |
| 2009/0082233 | A1 | 3/2009 | Kasai | |
| 2009/0215657 | A1 * | 8/2009 | Ripple | 508/186 |
| 2009/0233822 | A1 | 9/2009 | Iyer | |
| 2009/0305922 | A1 | 12/2009 | Cha et al. | |
| 2010/0081594 | A1 * | 4/2010 | Walker | 508/287 |
| 2012/0208731 | A1 * | 8/2012 | Lann et al. | 508/187 |
| 2012/0329692 | A1 | 12/2012 | Noles et al. | |

FOREIGN PATENT DOCUMENTS

| | | |
|---|---|---|
| JP | 2005-255996 | 9/2005 |
| JP | 2009-235258 | 10/2009 |
| WO | WO 88/04684 | 6/1988 |
| WO | WO 2007/044820 | 4/2007 |
| WO | WO 2009/118984 | 10/2009 |

* cited by examiner

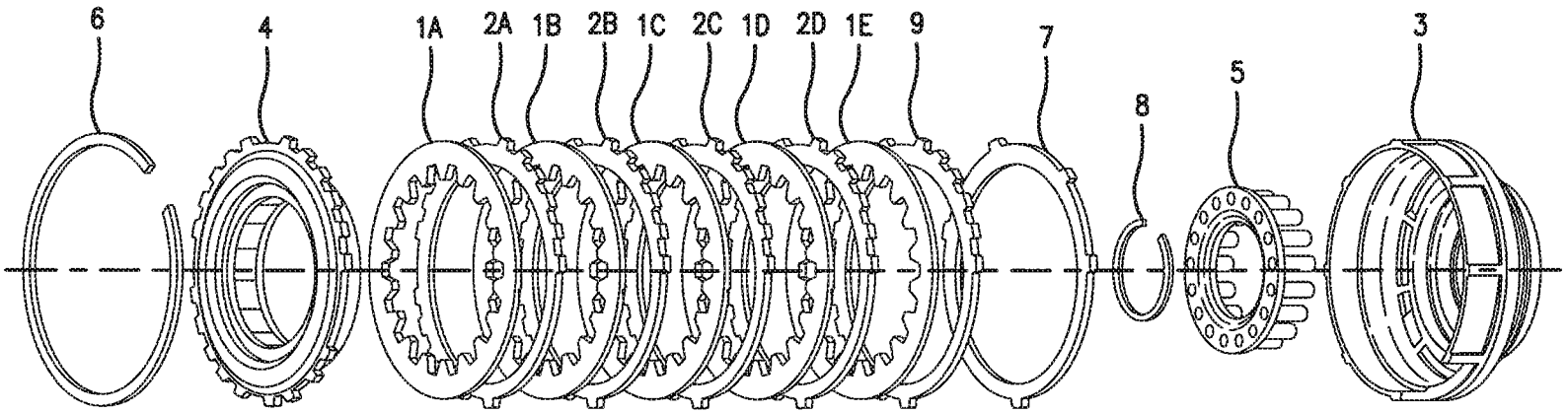
3
5
8
7
9
1E
2D
1D
2C
1C
2B
1B
2A
1A
4
6

WET FRICTION CLUTCH—LUBRICANT SYSTEMS PROVIDING HIGH DYNAMIC COEFFICIENTS OF FRICTION THROUGH THE USE OF BORATED DETERGENTS

FIELD OF THE INVENTION

This invention relates to wet friction clutch—lubricant systems capable of generating a high dynamic coefficient of friction, as well as a method for increasing the dynamic coefficient of friction developed in a wet friction clutch, such as those commonly used in vehicular automatic transmissions. More particularly, the present invention is directed to a wet friction clutch having a surface coating of silica based particles lubricated with a lubricant containing a borated detergent, the combination of which develops significantly higher dynamic friction level than when such a wet clutch is lubricated with comparable lubricants formulated without the specified detergent.

BACKGROUND OF THE INVENTION

The continuing pursuit of more fuel efficient motor vehicles is forcing vehicular automatic transmission builders to make transmissions ever more energy efficient. There are a number of types of automatic transmission including stepped automatic transmissions, automated manual transmissions, continuously variable transmissions and dual clutch transmissions. Each type of automatic transmission offers some advantages over the others when used in motor vehicles, however, the ability to reduce size and weight provides a benefit regardless of type. In any automatic transmission where a paper composite, fluid lubricated clutch is used (e.g. stepped automatic transmissions, continuously variable transmissions and dual clutch transmissions), reduction in the size by, for example, reducing the number of plates used in the clutch, will reduce the size and weight of the overall transmission. Increasing the friction level in the clutch has the desirable effect of increasing the level of torque that can be transferred through the clutch which, in turn, requires less surface area to transmit the same amount of torque. Therefore, in a wet clutch having, for example, five fiber composite plates, a 20% increase in dynamic friction provided by the fluid and friction lining would allow for the removal of one paper plate and one steel plate, thereby providing a corresponding 20% decrease in the weight and size of the clutch.

Applicants have now discovered that lubricating fluids, particularly lubricating power transmitting fluids, more particularly automatic transmission fluids, incorporating borated detergents, when used in conjunction with wet friction clutches having composite friction linings having a surface coating of silica based particles, produce wet friction clutch—lubricant systems that deliver increased levels of dynamic friction that enable the transmissions in which they are used to be made smaller, decreasing the size and weight of the transmission and resulting in an improvement in fuel efficiency for the overall vehicle.

U.S. Pat. No. 4,792,410, Schwind et al. discloses the use of a combination of a friction modifier and borated metal detergent where the metal ion is an alkali metal or alkaline earth metal, in lubricants for manual transmissions, and exemplifies the use of overbased borated sodium detergents. The use of the claimed lubricants is to provide reduced double detent and clashing (which relates to metal on metal contact) during manual transmission shifting. Manual transmissions do not contain wet friction clutches. The Schwind et al. patent does not suggest that the selection of the metal ion of the detergent has any effect on performance and does not discuss or contemplate the use of the compositions disclosed therein in automatic transmissions or in conjunction with any other device including wet friction clutches.

U.S. Pat. No. 6,451,745 to Ward discloses lubricants for use in continuously variable transmissions which lubricants contain a borated dispersant and a borated detergent, which lubricants have a boron content of at least 250 ppm. The Ward patent does not describe wet friction clutches having composite friction linings having a surface coating of silica based particles, or suggest that the selection of the borated detergent has any effect on paper based clutch performance, especially in the level of friction generated.

SUMMARY OF THE INVENTION

In a first aspect, the invention is directed to a wet friction clutch—lubricant system wherein a wet friction clutch having a cellulose—based friction lining having a surface coating of silica based particles, or a device including such a clutch, is lubricated with a lubricant composition comprising a major amount of oil of lubricating viscosity and minor effective amounts of (a) ashless dispersant; (b) organic phosphorus compound and (c) borated detergent. Preferably, the device containing the wet friction clutch having the cellulose—based friction lining having a surface coating of silica based particles is an automatic transmission, particularly a vehicular automatic transmission.

In a second aspect, the invention is directed to a method of lubricating a wet friction clutch having a cellulose—based friction lining having a surface coating of silica based particles, or a device including such a clutch, comprising the steps of lubricating the clutch or device with a lubricant composition comprising a major amount of oil of lubricating viscosity and a minor effective amounts of (a) ashless dispersant; (b) organic phosphorus compounds and (c) borated detergent. As in the first aspect, the device containing the wet friction clutch having a cellulose—based friction lining having a surface coating of silica based particles is preferably an automatic transmission, particularly a vehicular automatic transmission.

In a third aspect, the invention is directed to a power transmission fluid comprising a major amount of oil of lubricating viscosity and minor effective amounts of (a) one or more ashless dispersants; (b) one or more organic phosphorus compounds and (c) one or more borated detergents, wherein said fluid has a total base number, or TBN of less than 5.0 mg KOH/g (as measured in accordance with ASTM D2896), a boron content of less than 200 ppm, and a phosphorus content of less than 500 ppm.

BRIEF DESCRIPTION OF THE DRAWINGS

FIG. 1 is an exploded view of a wet friction clutch, as would be used in a vehicular automatic transmission.

DETAILED DESCRIPTION OF THE INVENTION

A wet friction clutch, as would be configured in a vehicular automatic transmission, is shown in FIG. 1. can have a plurality of clutch plates, each including a cellulose—based friction lining 1A through 1E (also referred to as a composite friction disk) and an associated reaction plate 2A through 2D, conventionally formed of steel, packed in a housing 3 between an apply piston 4 and a release spring 5. Such assemblies may further include other components, such as a waved plate 7, which acts to cushion the clutch apply, spacer plates 9, as may be needed, and retention rings 6 and 8. For friction lining 1A, apply piston 4 further functions as the corresponding reaction plate. The wet friction clutch is operated by the selective application of fluid pressure using a lubricating power transmitting fluid.

The ability to provide high levels of friction in paper composite fluid lubricated (wet) clutches is a highly desirable property of a lubricant. The increase in dynamic friction levels over those provided by conventional lubricants can be accomplished by the use of specific formulations containing borated detergents of the current invention with cellulose based friction linings having a surface coating of silica based particles. The necessary components are described below in more detail.

Lubricating oils useful in the practice of the present invention are natural lubricating oils, synthetic lubricating oils and mixtures thereof. Suitable lubricating oils also include base stocks obtained by isomerization of synthetic wax and slack wax, as well as base stocks produced by hydrocracking (rather than by solvent treatment) the aromatic and polar components of a crude oil. In general, suitable lubricating oils will have a kinematic viscosity ranging from about 1 to about 40 $mm^2/s$ (cSt) at 100° C. Typical applications will require the lubricating oil base stocks or base stock mixture to have a viscosity preferably ranging from about 1 to about 40 $mm^2/s$ (cSt), more preferably, from about 2 to about 8 $mm^2/s$ (cSt), most preferably, from about 2 to about 6 $mm^2/s$ (cSt), at 100° C.

Natural lubricating oils include animal oils, vegetable oils (e.g., castor oil and lard oil), petroleum oils, mineral oils, and oils derived from coal or shale. The preferred natural lubricating oil is mineral oil.

The mineral oils useful in the practice of the invention include all common mineral oil base stocks. This would include oils that are naphthenic or paraffinic in chemical structure as well as oils that are refined by conventional methodology using acid, alkali, and clay or other agents such as aluminum chloride, as well as extracted oils produced, e.g., by solvent extraction or treatment with solvents such as phenol, sulfur dioxide, furfural, dichlorodiethyl ether, etc. They may be hydro treated or hydro refined, dewaxed by chilling or catalytic dewaxing processes, or hydro cracked. The mineral oil may be produced from natural crude sources or be composed of isomerized wax materials or residues of other refining processes.

A particularly useful class of mineral oils includes those mineral oils that are severely hydro treated or hydro cracked. These processes expose the mineral oils to very high hydrogen pressures at elevated temperatures in the presence of hydrogenation catalysts. Typical processing conditions include hydrogen pressures of approximately 3000 pounds per square inch (psi) at temperatures ranging from 300° C. to 450° C. over a hydrogenation-type catalyst. This processing removes sulfur and nitrogen from the lubricating oil and saturates any alkylene or aromatic structures in the feedstock. The result is a base oil with extremely good oxidation resistance and viscosity index. A secondary benefit of these processes is that low molecular weight constituents of the feed stock, such as waxes, can be isomerized from linear to branched structures thereby providing finished base oils with significantly improved low temperature properties. These hydro treated base oils may then be further dewaxed either catalytically or by conventional means to give them exceptional low temperature fluidity. Commercial examples of lubricating base oils made by one or more of the aforementioned processes are Chevron RLOP, Petro-Canada P65, Petro-Canada P100, Yukong, Ltd., Yubase 4, Imperial Oil Canada MXT, and Shell XHVI 5.2. These materials are commonly referred to as API Group III mineral oils.

Typically such mineral oils will have kinematic viscosities of from about 2.0 $mm^2/s$ (cSt) to about 10.0 $mm^2/s$ (cSt) at 100° C. Preferred mineral oils have kinematic viscosities of from about 2 to about 6 $mm^2/s$ (cSt), and most preferred are those mineral oils with kinematic viscosities of from about 3 to about 5 $mm^2/s$ (cSt), at 100° C.

Synthetic lubricating oils useful in the practice of the invention include hydrocarbon oils and halo-substituted hydrocarbon oils such as oligomerized, polymerized, and interpolymerized olefins (e.g., polybutylenes, polypropylenes, propylene, isobutylene copolymers, chlorinated polylactenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.]; and alkylated diphenyl ethers, alkylated diphenyl sulfides, as well as derivatives, analogs, and homologs thereof, and the like. The preferred oils from this class of synthetic oils are oligomers of α-olefins, particularly oligomers of 1-decene. These materials are commonly referred to as poly-α-olefins.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000-1500); and mono- and poly-carboxylic esters thereof (e.g., the acetic acid esters, mixed $C_3$-$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethylhexanoic acid, and the like. Preferred types of synthetic oils include adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra(2-ethylhexyl)silicate, tetra(4-methyl-2-ethylhexyl)silicate, tetra(p-tert-butylphenyl)silicate, hexa(4-methyl-2-pentoxy) disiloxane, poly(methyl)siloxanes and poly(methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined oils, re-refined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oil breakdown products.

Typically, the lubricating oil used in this invention will be a natural lubricating oil. If a synthetic lubricating oil basestock is used, it is preferably a poly-α-olefin, monoester, diester, polyolester, or mixtures thereof. The preferred synthetic lubricating oil is a poly-α-olefin.

Ashless dispersants useful in the practice of the present invention include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos. 3,018,247; 3,018,250; 3,018,291; 3,361,673 and 4,234,435. Mixed ester-amides of hydrocarbyl-substituted succinic acids are described, for example, in U.S. Pat. Nos. 3,576,743; 4,234,435 and 4,873,009. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. Nos. 3,275,554; 3,438,757; 3,454,55 and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine. Low cost poly(ethyleneamines) (PAM) averaging about 5 to 7 nitrogen atoms per molecule are available commercially under trade names such as "Polyamine H", "Polyamine 400", Dow Polyamine E-100", etc. Hydroxy-substituted amines include N-hydroxyalkyl-alkylene polyamines such as N-(2-hydroxyethyl)ethylene diamine, N-(2-hydroxyethyl)piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

To form the ashless dispersant, the amine is readily reacted with the selected hydrocarbyl-substituted dicarboxylic acid material, e.g., alkylene succinic anhydride, by heating an oil solution containing 5 to 95 wt. % of said hydrocarbyl-substituted dicarboxylic acid material at about 100° to 250° C., preferably 125° to 175° C., generally for 1 to 10 hours (e.g., 2 to 6 hours) until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6 (e.g., 0.4 to 0.6), equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) may preferably be used to convert into a mixture of amides and imides, a composition derived from reaction of polyolefin and maleic anhydride having a functionality of 1.6; i.e., preferably the pentamine is used in an amount sufficient to provide about 0.4 equivalents (that is, 1.6 divided by (0.8×5) equivalents) of succinic anhydride units per reactive nitrogen equivalent of the amine.

Use of alkenyl succinimides which have been treated with a borating agent are also suitable for use in the compositions of this invention as they are much more compatible with elastomeric seals made from such substances as fluoro-elastomers and silicon-containing elastomers. Dispersants may be also be post-treated with many reagents known to those skilled in the art (see, for example U.S. Pat. Nos. 3,254,025; 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 300 to 2500 (preferably 400 to 2200). It has been found that selecting certain dispersants within the broad range of alkenyl succinimides produces fluids with improved frictional characteristics. The most preferred dispersants of this invention are those wherein the polyisobutene substituent group has a molecular weight of approximately 950 atomic mass units, the basic nitrogen containing moiety is polyamine (PAM) and the dispersant has been post treated with a boronating agent.

The ashless dispersants of the invention can be used in any effective amount. However, they are typically used from about 0.1 to about 10.0 mass % in the finished lubricant, preferably from about 0.5 to about 7.0 mass % and most preferably from about 2.0 to about 5.0 mass %.

Oil-soluble phosphorus-containing compounds useful in the practice of the present invention may vary widely and are not limited by chemical type. The only limitation is that the material be oil soluble so as to permit the dispersion and transport of phosphorus-containing compound within the lubricating oil system to its site of action. Examples of suitable phosphorus compounds are phosphites and thiophosphites(mono-alkyl, di-alkyl, tri-alkyl and partially hydrolyzed analogs thereof); phosphates and thiophosphates; amines treated with inorganic phosphorus such as phosphorous acid, phosphoric acid or their thio analogs; zinc dithiodiphosphates; amine phosphates. Examples of particularly suitable phosphorus compounds include mono-n-butyl-hydrogen-acid-phosphite; di-n-butyl-hydrogen phosphite; triphenyl phosphite; triphenyl thiophosphite; tri-n-butylphosphate; trilauryltrithiophosphite; dimethyl octadecenyl phosphonate, low molecular weight (e.g., 900 MW or less polyisobutenyl) polyisobutenyl succinic anhydride (PIBSA) polyamine dispersant post treated with $H_3PO_3$ and $H_3BO_3$ (see for example, U.S. Pat. No. 4,857,214); and zinc (di-2-ethylhexyldithiophosphate).

The preferred oil soluble phosphorus compounds are the esters of phosphoric and phosphorous acid. These materials include the di-alkyl, tri-alkyl and tri-aryl phosphites and phosphates. A preferred oil soluble phosphorus compound is the mixed thioalkyl phosphite esters, for example as produced as described in U.S. Pat. No. 5,314,633. The most preferred phosphorus compounds are thioalkyl phosphites, for example those illustrated by Example B1, below.

The phosphorus compounds of the invention can be used in the oil in any effective amount. However, a typical effective concentration of such compounds would be that delivering from about 5 to about 5000 ppm phosphorus into the oil. A preferred concentration range is from about 10 to about 1000 ppm of phosphorus in the finished oil and the most preferred concentration range is from about 50 to about 500 ppm.

Example B1

An alkyl phosphite mixture was prepared by placing in a round bottom 4-neck flask equipped with a reflux condenser a stirrer and a nitrogen bubbler, 194 grams (1.0 mole) of dibutyl hydrogen phosphite. The flask was flushed with nitrogen, sealed and the stirrer started. The dibutyl hydrogen phosphite was heated to 150° C. under vacuum (~90 kPa) and 190 grams (1 mole) of hydroxylethyl-n-octyl sulfide was added through a dropping funnel over about one hour. During the addition approximately 35 mls of butanol was recovered in a chilled trap. Heating was continued for about one hour after the addition of the hydroxylethyl-n-octyl sulfide was completed; no additional butanol evolved. The reaction mixture was cooled and analyzed for phosphorus and sulfur. The final product had a total acid number or TAN (as measured in accordance with ASTM D-664) of 115 mg KOH/g and contained 8.4 mass % of phosphorus and 9.1 mass % of sulfur.

The third required component of the present invention is a borated detergent. The metal-containing detergents of the compositions of this invention are exemplified by oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkylphenols. The preferred salts useful with this invention are overbased salts of calcium or magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl α-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-containing detergents include, but are not limited to, neutral and overbased salts of such substances as calcium phenates, magnesium phenates, sulfurized calcium phenates, and sulfurized magnesium phenates wherein each aromatic group has one or more aliphatic groups to impart hydrocarbon solubility; calcium sulfonates, and magnesium sulfonates wherein each sulfonic acid moiety is attached to an aromatic nucleus which in turn usually contains one or more aliphatic substituents to impart hydrocarbon solubility; calcium salicylates and magnesium salicylates wherein the aromatic moiety is usually substituted by one or more aliphatic substituents to impart hydrocarbon solubility; calcium and magnesium salts of aliphatic carboxylic acids and aliphatic substituted cycloaliphatic carboxylic acids; and many other similar alkali and alkaline earth metal salts of oil-soluble organic acids. Mixtures of neutral or overbased salts of two or more different alkali and/or alkaline earth metals can be used. Likewise, neutral and/or overbased salts of mixtures of two or more different acids (e.g., one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil-soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, have sometimes been simply called neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See, e.g., U.S. Pat. Nos. 2,001,108; 2,081,075; 2,095,538; 2,144,078; 2,163,622; 2,270,183; 2,292,205; 2,335,017; 2,399,877; 2,416,281;

2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; and 4,880,550.

The metallic detergents described above can be boronated by processes know to those skilled in the art. Boration can be accomplished either prior to, or after, the overbasing step. The boration can be accomplished by a number of boronating agents; materials useful for boration would include boric acid, metaboric acid, orthoboric acid, alkyl borates, boron halides, polymers of boron, esters of boron and similar materials. Methods for preparing boronated metallic detergents are described in, e.g., U.S. Pat. Nos. 3,480,548; 3,679,584; 3,829,381; 3,909,691; 4,965,003; and 4,965,004. The boron content of the products useful in this invention is typically greater than 3 mass percent, preferably greater than 4 mass percent and most preferably greater than 5 mass percent.

Preferred metallic detergents for use with this invention are borated overbased magnesium sulfonates.

The amount of metallic detergent used can vary broadly and is not critical to the practice of this invention. This amount need only be that effective to increase the dynamic friction provided by the composition. Typically, however, this amount will range from 0.01 to 10.0 wt. %, preferably from 0.05 to 7.0 wt. %, and most preferably from 0.1 to 0.5 wt. % in the finished fluid. Preferably, the metallic detergent will be used in an amount providing the lubricant composition with at least 25 ppm, such as at least 50 ppm, preferably at least 100 ppm, such as at least 150 ppm, of boron.

Example C1

A borated magnesium sulfonate was prepared by drop wise addition of a solution of 750 gm of a commercial magnesium sulfonate (Infineum C9340) in 250 gm of toluene to a stirred refluxing mixture of orthoboric acid (600 gm; 9.7 moles) in 1600 gm of toluene in a five liter round bottom flask fitted with a Dean Stark trap. The addition was made over about one hour in order to control foaming. When the addition was complete, 95 cc (approximately 5.25 moles) of water had been collected. A further charge of 750 gm of magnesium sulfonate diluted in 250 gm of toluene (as above) was slowly added to the refluxing mixture. The reflux was continued for 6 hours at which time a total of 193 gm (10.7 moles) of water had been collected. The reaction mixture was cooled and centrifuged to remove suspended solids. It was then transferred to a clean flask and the toluene distilled off under vacuum to yield 1840 gm of borated magnesium sulfonate. Analysis: Mg: 7.36%; B: 5.79%; S: 1.38%; TBN (ASTM D2896): 337; TAN (ASTM D664): 147 mgKOH/gm.

Example C2

A borated calcium sulfonate was prepared by drop wise addition of a solution of 1500 gm of a commercial calcium sulfonate (Infineum C9330) in 500 gm of toluene to a stirred refluxing mixture of orthoboric acid (500 gm; 8.1 moles) in 2000 gm of toluene in a five liter round bottom flask fitted with a Dean Stark trap. The addition was made over several hours in order to control foaming. The reflux was continued until water evolution ceased at which time a total of 210 gm (11.7 moles) of water had been collected. The reaction mixture was cooled and centrifuged to remove suspended solids. It was then transferred to a clean flask and the toluene distilled off under vacuum to yield 1772 gm of borated magnesium sulfonate. Analysis: Ca: 9.22%; B: 5.86%; S: 1.41%; TBN (ASTM D2896): 243; TAN (ASTM D664): 80 mgKOH/gm; Carbonate (as $CO_2$): 5.7%.

Lubricants useful in the practice of the present invention may further contain, and in one preferred embodiment do contain, a friction modifier. Friction modifiers are well known to those skilled in the art and a useful list of suitable friction modifiers is included in U.S. Pat. Nos. 4,792,410; 5,750,476; 5,840662 and 5,942,472. Useful friction modifiers friction modifiers include fatty phosphites; fatty acid amides; fatty epoxides, borated fatty epoxides; fatty amines; glycerol esters; borated glycerol esters; alkoxylated fatty amines; borated alkoxylated fatty amines; metal salts of fatty acids; sulfurized olefins; fatty imidazolines; condensation products of carboxylic acids and/or anhydrides and polyalkylene-polyamines; metal salts of alkyl salicylates; amine salts of alkylphosphoric acids; and combinations thereof.

Materials representatives of each of the above types of friction modifiers are known and are commercially available. For instance, fatty phosphites are generally of the formula $(RO)_2PHO$. The preferred dialkyl phosphite, as shown in the preceding formula, is typically present with a minor amount of monoalkyl phosphite of the formula (RO)(HO)PHO. In these structures, the term "R" is conventionally referred to as an alkyl group. It is, of course, possible that the alkyl is actually alkenyl and thus the terms "alkyl" and "alkylated," as used herein, will embrace other than saturated alkyl groups within the phosphite. The phosphite should have sufficient hydrocarbyl groups to render the phosphite substantially oleophilic. Preferably the hydrocarbyl groups are substantially unbranched. Many suitable phosphites are available commercially and may be synthesized as described in U.S. Pat. No. 4,752,416. It is preferred that the phosphite contain 8 to 24 carbon atoms in each of R groups. Preferably, the fatty phosphite contains 12 to 22 carbon atoms in each of the fatty radicals, most preferably 16 to 20 carbon atoms. In one embodiment the fatty phosphite is formed from oleyl groups, thus having 18 carbon atoms in each fatty radical.

Borated fatty epoxides are known from Canadian Patent No. 1,188,704. These oil-soluble boron containing compositions are prepared by reacting at a temperature from about 80° C. to about 250° C., at least one of boric acid or boron trioxide with at least one fatty epoxide having the formula

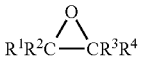

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_40_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation. Non-borated fatty epoxides, corresponding to "Reagent B" above, are also useful as friction modifiers.

Borated amines are generally known from U.S. Pat. No. 4,622,158. Borated amine friction modifiers (including borated alkoxylated fatty amities) are conveniently prepared by the reaction of a boron compounds, as described above, with the corresponding amines. The amine can be a simple fatty amine or hydroxy containing tertiary amines.

The borated amines can be prepared by adding the boron reactant, as described above, to an amine reactant and heating the resulting mixture at a 50 to 300° C., preferably 100° C. to 250° C. or 150° C. to 230° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis(2-hydroxyethyl)cocoamine); ETHOMEEN™ C/20 (polyoxyethylene(10)cocoamine); ETHOMEEN™ S/12 (bis(2-hydroxyethyl)soyamine); ETHOMEEN™ T/12 (bis(2-hydroxyethyl)tallowamine); ETHOMEEN™ T/15 (polyoxyethylene-(5)tallowamine); ETHOMEEN™ 0/12 (bis(2-hydroxyethyl)oleyl-amine); ETHOMEEN™ 18/12 (bis(2-hydroxyethyl)octadecylamine); and ETHOMEEN™ 18/25 (polyoxyethylene(15) octadecylamine). Fatty amines and ethoxylated fatty amities are also described in U.S. Pat. No. 4,741,848.

The alkoxylated fatty amines, and fatty amines themselves (such as oleylamine) are generally useful as friction modifiers in this invention. Such amines are commercially available. Fatty diamines such as di-cocoa amine and di-tallow amine and their derivatives prepared by reaction with acids, anhydrides or epoxides are also useful. Reaction products such as described in U.S. Published Patent Application No. 2006/0084583 and WO2007/044820 are also useful.

Both borated and unborated fatty acid esters of glycerol can be used as friction modifiers. The borated fatty acid esters of glycerol are prepared by borating a fatty acid ester of glycerol with boric acid with removal of the water of reaction. Preferably, there is sufficient boron present such that each boron atom will react with from 15 to 2.5 hydroxyl groups present in the reaction mixture. The reaction may be carried out at a temperature in the range of 60° C. to 135° C., in the absence or presence of any suitable organic solvent such as methanol, benzene, xylene, toluene, or oil.

Fatty acid esters of glycerol themselves can be prepared by a variety of methods well known in the art. Many of these esters, such as glycerol monooleate and glycerol tallowate, are manufactured on a commercial scale. The esters useful are oil-soluble and are preferably prepared from $C_8$ to $C_{22}$ fatty acids or mixtures thereof such as are found in natural products and as are described in greater detail below. Fatty acid monoesters of glycerol are preferred, although, mixtures of mono and diesters may be used. For example, commercial glycerol monooleate may contain a mixture of 45% to 55% by weight monoester and 55% to 45% diester.

Fatty acids can be used in preparing the above glycerol esters; they can also be used in preparing their metal salts, amides, and imidazolines, any of which can also be used as friction modifiers. Preferred fatty acids are those containing 6 to 24 carbon atoms, preferably 8 to 18. The acids can be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. A particularly preferred acid is oleic acid. Preferred metal salts include zinc and calcium salts. Examples are overbased calcium salts and basic oleic acid-zinc salt complexes which can be represented by the general formula $Zn_4Oleate_30_1$. Preferred amides are those prepared by condensation with ammonia or with primary or secondary amines such as diethylamine and diethanolamine. Fatty imidazolines are the cyclic condensation product of an acid with a diamine or polyamine such as a polyethylenepolyamine. The imidazolines are generally represented by the structure

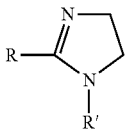

where R is an alkyl group and R' is hydrogen or a hydrocarbyl group or a substituted hydrocarbyl group, including $—(CH_2CH_2NH)_n—$ groups. In a preferred embodiment the friction modifier is the condensation product of a $C_8$ to $c_{24}$ fatty acid with a polyalkylene polyamine, and in particular, the product of isostearic acid with tetraethylenepentamine. The condensation products of carboxylic acids and polyalkyleneamines may generally be imidazolines or amides.

Another suitable class of friction modifiers are those produced by the reaction of alkyl substituted succinic anhydrides with polyamines. For example, suitable materials include the condensation products of 3-octadenyl succinic anhydride with either di-ethylene triamine or tetraethylene pentamine. The preparation of these materials is described in U.S. Pat. No. 5,840,663.

Sulfurized olefins are well known commercial materials used as friction modifiers. A particularly preferred sulfurized olefin is one which is prepared in accordance with the detailed teachings of U.S. Pat. Nos. 4,957,651 and 4,959,168. Described therein is a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol. Reactant (3), the olefin component, comprises at least one 60 olefin. This olefin is preferably an aliphatic olefin, which usually will contain 4 to 40 carbon atoms, preferably from 8 to 36 carbon atoms. Terminal olefins, or alpha-olefins, are preferred, especially those having from 12 to 20 carbon atoms. Mixtures of these olefins are commercially available, and such mixtures are contemplated for use in this invention.

The cosulfurized mixture of two or more of the reactants, is prepared by reacting the mixture of appropriate reactants with a source of sulfur. The mixture to be sulfurized can contain 10 to 90 parts of reactant (1), or 0.1 to 15 parts by weight of reactant (2); or 10 to 90 parts, often 15 to 60 parts, more often 25 to 35 parts by weight of reactant (3), or 10 to 90 parts by weight of reactant (4). The mixture, in the present invention, includes reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present invention include elemental sulfur, which is preferred, hydrogen sulfide, sulfur halide, sodium sulfide and a mixture of hydrogen sulfide and sulfur or sulfur dioxide. Typically often 0.5 to 3 moles of sulfur are employed per mole of olefinic bonds.

Metal salts of alkyl salicylates include calcium and other salts of long chain (e.g. $C_{12}$ to $C_{16}$) alkyl-substituted salicylic acids.

Amine salts of alkylphosphoric acids include salts of oleyl and other long chain esters of phosphoric acid, with amines as described below; one useful type of amines in this regard is tertiary-aliphatic primary amines (Primene™).

The amount of the friction modifier is generally 0.05 to 8.0 percent by weight of the lubricating composition, preferably 0.1 to 7.0 or 0.25 to 5.0 percent.

It is known that some of the materials described above may interact in the formulated lubricant, so that the components of the final lubricant may be different from those that are initially added. For instance, metal ions (of e.g., a detergent) can migrate to the acidic sites of other molecules. The products formed thereby, including the products formed upon employing the composition of the present invention in its intended use, may not be amenable to easy description. Nevertheless, all such modifications and reaction products are included within the scope of the present invention; the present invention therefore encompasses the composition prepared by admixing the components described above.

Although the use of various boron-containing additives is described, including borated dispersants and boron-containing friction modifiers, in one preferred embodiment, the boron content of the lubricant compositions of the present invention is maintained below 200 ppm, such as below 150 ppm.

Friction linings for wet clutches are known in the general art and are manufactured by a number of companies, e.g. BorgWarner Automotive, Auburn Hills, Mich.; Dynax Ltd., Hokkaido, Japan; NSK, Ltd, Tokyo, Japan. The particular materials that are included in this invention are those friction clutch linings containing silica based particles, more preferred are those that have a surface layer of silica based particles. Examples of such particles are Celite®, Celatom®, diatomaceous earth and/or silicon dioxide. The preparation and use of these materials is described, for example, in U.S. Pat. Nos. 5,585,166; 6,121,168 and 6,875,711, the subject matter of which is incorporated herein by reference.

Example 1

A test fluid is prepared by dissolving equal amounts based on the moles of sulfonic acid contained in the metallic detergent (4.2 mmoles/kg) in an API Group III mineral oil (Yubase 3, available from the SK Corporation). Each test fluid was then evaluated for friction versus sliding speed characteristics on a Low Velocity Friction Apparatus (LVFA), using different paper based friction linings over a range of temperatures. The fluid was added to the test cell of the LVFA which had been fitted with parts made up of the appropriate paper based friction lining and a steel disc to run it against. The system was broken in for 30 minutes and the temperature increased to 150° C. and held for one hour. After the one hour aging the friction characteristics versus temperature were measured at 150° C., 120° C. and 80° C. The table 1 below gives the value of the measured friction coefficient at 1.0 meters/second (m/s) sliding speed at the three temperatures.

TABLE 1

Single Component LVFA Friction Coefficient at 1.0 m/s

| | Ca Based Detergent | | | | | | Mg Based Detergent | | | | | |
|---|---|---|---|---|---|---|---|---|---|---|---|---|
| Friction | Plain (4) | | | Borated (5) | | | Plain (6) | | | Borated (7) | | |
| Material | 80° C. | 120° C. | 150° C. | 80° C. | 120° C. | 150° C. | 80° C. | 120° C. | 150° C. | 80° C. | 120° C. | 150° C. |
| NW 561E (1) | 0.149 | 0.150 | 0.148 | 0.149 | 0.146 | 0.144 | 0.155 | 0.155 | 0.152 | 0.149 | 0.146 | 0.144 |
| BW 6500 (2) | 0.168 | 0.172 | 0.172 | 0.197 | 0.211 | 0.228 | 0.175 | 0.178 | 0.182 | 0.210 | 0.235 | 0.261 |
| D 831-70 (3) | 0.193 | 0.205 | 0.207 | 0.189 | 0.197 | 0.201 | 0.184 | 0.192 | 0.198 | 0.202 | 0.216 | 0.226 |

(1) available from NSK Warner Corporation
(2) available from BorgWarner Corporation
(3) available from Dynax Corporation
(4) Infineum C9330, available from Infineum
(5) product of Example C2
(6) Infineum C9340, available from Infineum
(7) product of Example C1

The friction material NW 561E is a comparative example as it does not contain a surface layer of silica based particles. It is clear that the friction coefficient generated by the borated and plain (non-borated) versions of the detergents is the same. Both BW 6500 and D831-70 contain silica particle surface layers. The data indicates that the borated calcium sulfonate gives higher friction than the plain (non-borated) version on this material, however it does not yield higher friction on the D 831-70 material. Only the borated magnesium sulfonate gives higher friction levels on both materials.

It can be seen from this data that the borated magnesium sulfonate yielded friction coefficients that were anywhere from 9 to 30 percent higher than those achieved with either of the non-borated versions over the range of conditions tested.

Example 2

A test fluid is prepared by dissolving equal amounts based on the moles of sulfonic acid contained in the metallic detergent (4.2 mmoles/kg) in an API Group III mineral oil (Yubase 3) which also contained 1.5 mass percent of a dispersant made of a 950 MW PIBSA and commercial polyamine (PAM) and 0.125 mass percent of dibutyl hydrogen phosphite (250 ppm P). Each test fluid was then evaluated for friction versus sliding speed characteristics on a Low Velocity Friction Apparatus (LVFA), using different paper based friction linings over a range of temperatures. The fluid was added to the test cell of the LVFA which had been fitted with parts made up of the appropriate paper based friction lining and a steel disc to run it against. The system was broken in for 30 minutes and the temperature increased to 150° C. and held for one hour. After the one hour aging the friction characteristics versus temperature were measured at 150° C., 120° C. and 80° C. Table 2 below gives the value of the measured friction coefficient at 1.0 meters/second (m/s) sliding speed at all three temperatures.

TABLE 2

Formulated Lubricants - LVFA Friction Coefficient at 1.0 m/s

| Friction | Ca Based Detergent | | | | | | Mg Based Detergent | | | | | |
|---|---|---|---|---|---|---|---|---|---|---|---|---|
| | Plain (4) | | | Borated (5) | | | Plain (6) | | | Borated (7) | | |
| Material | 80° C. | 120° C. | 150° C. | 80° C. | 120° C. | 150° C. | 80° C. | 120° C. | 150° C. | 80° C. | 120° C. | 150° C. |
| NW 561E (1) | 0.150 | 0.153 | 0.152 | 0.141 | 0.139 | 0.140 | 0.150 | 0.151 | 0.152 | 0.141 | 0.140 | 0.144 |
| BW 6500 (2) | 0.169 | 0.173 | 0.173 | 0.169 | 0.172 | 0.173 | 0.169 | 0.173 | 0.173 | 0.180 | 0.185 | 0.191 |
| D 831-70 (3) | 0.193 | 0.204 | 0.206 | 0.200 | 0.210 | 0.216 | 0.193 | 0.201 | 0.202 | 0.203 | 0.215 | 0.221 |

(1) available from NSK Warner Corporation
(2) available from BorgWarner Corporation
(3) available from Dynax Corporation
(4) Infineum C9330, available from Infineum
(5) product of Example C2
(6) Infineum C9340, available from Infineum
(7) product of Example C1

Again it can be seen that in the formulated products, the borated magnesium sulfonate yielded higher friction coefficients on both materials than the calcium version; and that no effect was seen on the control material; NW 561E. Friction coefficients with the borated version of the magnesium sulfonate were anywhere from 5 to 12 percent higher than those achieved with the non-borated version over the range of materials and conditions tested.

Each of the documents referred to above is incorporated herein by reference. Except in Examples, or where otherwise explicitly stated, all numerical quantities in this description specifying amounts of materials, reaction conditions, molecular weights, numbers of carbon atoms, and the like are to be understood as modified by the word "about". Unless otherwise indicated, each chemical or composition referred to herein should be interpreted as being a commercial grade material which may contain isomers, by-products, derivatives, and other materials which are normally understood to be present in the commercial grade. However, the amount of each chemical component is presented exclusive of any solvent or diluent oil which may be customarily present in the commercial material, unless otherwise indicated. It is also to be understood that the upper and lower amount, range and ratio limits set forth herein may be independently combined as can ranges of different components. As used herein, the expression "consisting essentially of" permits the inclusion of substances which do not materially affect the basic and novel characteristics of the composition under consideration.

Specific features and examples of the invention are presented for convenience only, and other embodiments according to the invention may be formulated that exhibit the benefits of the invention. These alternative embodiments will be recognized by those skilled in the art from the teachings of the specification and are intended to be embraced within the scope of the appended claims.

What is claimed is:

1. A wet friction clutch-lubricant system wherein a wet friction clutch having a cellulose-based friction lining having a surface coating of silica based particles, or a device including such a clutch, is lubricated with a lubricant composition comprising a major amount of oil of lubricating viscosity and minor effective amounts of (a) ashless dispersant; (b) organic phosphorus compound and (c) borated detergent, wherein said borated detergent comprises borated magnesium sulfonate detergent.

2. The wet friction clutch-lubricant system of claim 1, wherein said clutch is included in a device, and said device is a vehicular automatic transmission.

3. The wet friction clutch-lubricant system of claim 2, wherein said automatic transmission is of a type selected from the group consisting of stepped automatic transmissions, automated manual transmissions, continuously variable transmissions and dual clutch transmissions.

4. The wet friction clutch-lubricant system of claim 1, wherein said borated magnesium sulfonate detergent comprises an overbased borated magnesium sulfonate detergent.

5. The wet friction clutch-lubricant system of claim 2, wherein said organic phosphorus compound is selected from the group consisting of phosphites and thiophosphites(monoalkyl, di-alkyl, tri-alkyl and partially hydrolyzed analogs thereof); phosphates and thiophosphates; amines treated with inorganic phosphorus; zinc dithiodiphosphates; amine phosphates; and combinations thereof.

6. The wet friction clutch-lubricant system of claim 5, wherein said organic phosphorus compound is selected from the group consisting of mono-n-butyl-hydrogen-acid-phosphite; di-n-butyl-hydrogen phosphite; triphenyl phosphite; triphenyl thiophosphite; tri-n-butylphosphate; trilauryltrithiophosphite; dimethyl octadecenyl phosphonate, low molecular weight polyisobutenyl succinic anhydride polyamine dispersant post treated with $H_3PO_3$ and $H_3BO_3$; zinc (di-2-ethylhexyldithiophosphate); and combinations thereof.

7. The wet friction clutch-lubricant system of claim 5, wherein said organic phosphorus compound is selected from the group consisting of esters of phosphoric and phosphorous acid.

8. The wet friction clutch-lubricant system of claim 2, wherein said lubricant composition further comprises a minor effective amount of an auxiliary friction modifier.

9. The wet friction clutch-lubricant system of claim 8, wherein said auxiliary friction modifier is selected from the group consisting of fatty phosphites; fatty acid amides; fatty epoxides; borated fatty epoxides; fatty amines; glycerol esters; borated glycerol esters; alkoxylated fatty amines; borated alkoxylated fatty amines; metal salts of fatty acids; sulfurized olefins; fatty imidazolines; condensation products of carboxylic acids and/or anhydrides and polyalkylene-polyamines; metal salts of alkyl salicylates; amine salts of alkylphosphoric acids; and combinations thereof.

10. A method of lubricating a wet friction clutch having a cellulose-based friction lining having a surface coating of silica based particles, or a device including such a clutch, comprising the steps of lubricating the clutch or device with a lubricant composition comprising a major amount of oil of lubricating viscosity and a minor effective amounts of (a) ashless dispersant; (b) organic phosphorus compound and (c) borated detergent, wherein said borated detergent comprises borated magnesium sulfonate detergent.

11. The method of claim 10, wherein said clutch is included in a device, and said device is a vehicular automatic transmission.

12. The method of claim 11, wherein said automatic transmission is of a type selected from the group consisting of stepped automatic transmissions, automated manual transmissions, continuously variable transmissions and dual clutch transmissions.

13. The method of claim 10, wherein said borated magnesium sulfonate detergent comprises a borated overbased magnesium sulfonate detergent.

14. The method of claim 11, wherein said organic phosphorus compound is selected from the group consisting of phosphites and thiophosphites (mono-alkyl, di-alkyl, tri-alkyl and partially hydrolyzed analogs thereof); phosphates and thiophosphates; amines treated with inorganic phosphorus; zinc dithiodiphosphates; amine phosphates; and combinations thereof.

15. The method of claim 14, wherein said organic phosphorus compound is selected from the group consisting of mono-n-butyl-hydrogen-acid-phosphite; di-n-butyl-hydrogen phosphite; triphenyl phosphite; triphenyl thiophosphite; tri-n-butylphosphate; trilauryltrithiophosphite; dimethyl octadecenyl phosphonate, low molecular weight polyisobutenyl succinic anhydride polyamine post treated with $H_3PO_3$ and $H_3BO_3$; zinc (di-2-ethylhexyldithiophosphate); and combinations thereof.

16. The method of claim 14, wherein said organic phosphorus compound is selected from the group consisting of esters of phosphoric and phosphorous acid.

17. The method of claim 11, wherein said lubricant composition further comprises a minor effective amount of an auxiliary friction modifier.

18. The method of claim 17, wherein said auxiliary friction modifier is selected from the group consisting of fatty phosphites; fatty acid amides; fatty epoxides; borated fatty epoxides; fatty amines; glycerol esters; borated glycerol esters; alkoxylated fatty amines; borated alkoxylated fatty amines; metal salts of fatty acids; sulfurized olefins; fatty imidazolines; condensation products of carboxylic acids and/or anhydrides and polyalkylene-polyamines; metal salts of alkyl salicylates; amine salts of alkylphosphoric acids; and combinations thereof.

19. A power transmission fluid comprising a major amount of oil of lubricating viscosity and minor effective amounts of (a) one or more ashless dispersants; (b) one or more organic phosphorus compound and (c) borated detergent, wherein said borated detergents comprises borated magnesium sulfonate detergent, and wherein said fluid has a TBN of less than 5.0 mg KOH/g (as measured in accordance with ASTM D-2896), a boron content of less than 200 ppm, and a phosphorus content of less than 500 ppm.

20. The power transmission fluid of claim 19, wherein said borated magnesium sulfonate detergent comprises an overbased borated magnesium sulfonate detergent.

21. The power transmission fluid of claim 19, wherein said organic phosphorus compound is selected from the group consisting of phosphites and thiophosphites(mono-alkyl, di-alkyl, tri-alkyl and partially hydrolyzed analogs thereof); phosphates and thiophosphates; amines treated with inorganic phosphorus; zinc dithiodiphosphates; amine phosphates; and combinations thereof.

22. The power transmission fluid of claim 21, wherein said organic phosphorus compound is selected from the group consisting of mono-n-butyl-hydrogen-acid-phosphite; di-n-butyl-hydrogen phosphite; triphenyl phosphite; triphenyl thiophosphite; tri-n-butylphosphate; trilauryltrithiophosphite; dimethyl octadecenyl phosphonate, low molecular weight polyisobutenyl succinic anhydride polyamine dispersant post treated with $H_3PO_3$ and $H_3BO_3$; zinc (di-2-ethylhexyldithiophosphate); and combinations thereof.

23. The power transmission fluid of claim 21, wherein said organic phosphorus compound is selected from the group consisting of esters of phosphoric and phosphorous acid.

24. The power transmission fluid of claim 19, wherein said lubricant composition further comprises a minor effective amount of an auxiliary friction modifier.

25. The power transmission fluid of claim 24, wherein said auxiliary friction modifier is selected from the group consisting of fatty phosphites; fatty acid amides; fatty epoxides; borated fatty epoxides; fatty amines; glycerol esters; borated glycerol esters; alkoxylated fatty amines; borated alkoxylated fatty amines; metal salts of fatty acids; sulfurized olefins; fatty imidazolines; condensation products of carboxylic acids and/or anhydrides and polyalkylene-polyamines; metal salts of alkyl salicylates; amine salts of alkylphosphoric acids; and combinations thereof.

* * * * *